United States Patent [19]

Johnston et al.

[11] 4,065,304

[45] Dec. 27, 1977

[54] METHOD FOR FIXING INK IMAGES

[75] Inventors: Herbert N. Johnston; Joseph A. Wray, both of Columbus; Joe David Robbins, Pickerington, all of Ohio; Morton Schrager, Rochester, N.Y.

[73] Assignee: Xerox Corporation, Stamford, Conn.

[21] Appl. No.: 636,337

[22] Filed: Nov. 28, 1975

[51] Int. Cl.[2] ..... G03G 13/16; G03G 13/14

[52] U.S. Cl. ..... 96/1 LY; 427/16; 427/22

[58] Field of Search ..... 96/1 LY, 1, 4; 427/22, 427/24, 16, 17

[56] References Cited

U.S. PATENT DOCUMENTS

| | | | |
|---|---|---|---|
| 3,493,412 | 2/1970 | Johnston | 96/1.4 |
| 3,811,914 | 5/1974 | Saito et al. | 96/1.4 |
| 3,949,148 | 4/1976 | Akman | 96/1.4 |
| 3,966,467 | 6/1976 | Parent | 427/24 |

*Primary Examiner*—David Klein
*Assistant Examiner*—John L. Goodrow

[57] ABSTRACT

Pigment-oil suspension ink images are fixed by transferring the images to a transfer paper containing an oil-absorbent masking agent and a physically discontinuous overcoating of a thermoplastic fusing material, and then heating the composite to fuse and fix the images.

9 Claims, No Drawings

METHOD FOR FIXING INK IMAGES

BACKGROUND OF THE INVENTION

This invention relates to methods of fixing images to a transfer paper, specifically where the images are comprised of marking particles suspended in an oil carrier, and more specifically where the images are comprised of photosensitive pigments suspended in an oil carrier, as in photoelectrophoretic inks.

In the photoelectrophoretic imaging process, an image is formed from an imaging suspension or ink by subjecting the ink to an electric field and exposing it to activating electromagnetic radiation, e.g., visible light. The imaging suspension is comprised of light sensitive particles suspended within an insulating liquid carrier and believed to bear a net electrical charge while in suspension. Normally, the ink is placed between injecting and blocking electrodes used to establish the electric field and is exposed to a light image through one of the electrodes which is at least partially transparent. According to one theory, particles attracted to the injecting electrode by the electric field exchange charge with the injecting electrode when exposed to light and migrate under the influence of the field through the liquid carrier to the blocking electrode. As a result of the migration, positive and negative images are formed on the two electrodes. The blocking electrode is covered with a dielectric material to prevent charge exchange with the particles and thereby prevent the particles from oscillating back and forth between the two electrodes.

The photoelectrophoretic imaging process is either monochromatic or polychromatic depending upon whether the light sensitive particles within the liquid carrier are responsive to the same or different portions of the light spectrum. A full color polychromatic system is obtained, for example, by using cyan, magenta and yellow colored particles which are responsive to red, green, and blue light respectively. An extensive and detailed description of the photoelectrophoretic process is found in U.S. Pat. Nos. 3,384,565 and 3,384,484 to Tulagin and Carreira, 3,383,993 to Yeh and 3,384,566 to Clark, and the disclosures of these patents are expressly incorporated by reference into the present disclosure.

Following particle migration and image formation on the electrodes, the base, or injecting, electrode with the positive image thereon is separated from the blocking electrode. Where the positive is to be transferred, as it most often will be, the base electrode is contacted with the transfer member in some suitable manner, as described, for example, in U.S. Pat. Nos. 3,565,614; 3,642,364; and 3,705,797. The next step usually is to fix the transferred image to the transfer sheet, or if the image is to remain on the injecting electrode, to fix the image to the electrode. Generally, images formed by particles such as suspended pigments are fixed by somehow bonding the particles to the substrate material. Photoelectrophoretic ink images have, in the past, usually been fixed by thermoplastic bonding; i.e., the pigment particles are bound by softened thermoplastic materials, which upon cooling, re-harden and trap the pigments on the image substrate. The cited patents mention several methods for accomplishing the bonding. For example, a thermoplastic adhesive can be coated on the transfer member, softened, and contacted with the imaged electrode; the image is then pulled onto the transfer member, and the plastic allowed to cool to trap and bond the image particles. The transferred image or electrode image may alternatively be laminated with a thermoplastic material. Yet another approach involves inclusion of the bonding agent in the ink itself, which upon heating, traps the image particles in-situ.

However, all of the above transfer and fixing methods function optimally only when the insulating carrier for the marking particles is allowed to volatilize, or is otherwise disposed of. Where the carrier is a basically non-volatile material, such as an oil, it will interfere with the fixing process, particularly one which is designed to operate at higher speeds, as in a continuous belt or web system. In this instance, the process must operate slowly enough to allow the oil to be absorbed into the substrate or transfer paper. Otherwise, the oil will "bleed" out of the thermoplastic bond and result in an oily copy. Additional problems are encountered where the transfer member is pre-coated with a thermoplastic, in which case the oil will have to permeate the material before the image can be satisfactorily bonded. Additionally, absorption of the oil into the transfer sheet frequently results in spotting, or transparentizing, of the sheet. The same deficiencies are present when other tackifiable bonding materials are used, namely, dispose of the non-volatile carrier.

At first blush, it would seem that one solution to the problem would be use of an oil-absorbing material on the transfer sheet. The problem, however, still exists of fixing the pigment particles after the oil has been taken care of. For example, U.S. Pat. No. 3,811,914 teaches in part the selective incorporation of oil-absorbing materials, such as starch and clay, into transfer papers to adjust the oil absorption properties of the paper. The object therein is to minimize oil takeup by the paper without impeding toner particle takeup by the paper fibers. However, the inventors have found that even dense, wellformed images held by the presence of such absorption agents are still subject to damage in handling due to damage of the relatively frangible oil-absorbing materials.

SUMMARY OF THE INVENTION

It is therefore a principal object of this invention to provide an improved method and transfer sheet for accepting and protectively fixing liquid images comprised of particle-in-oil suspensions, particularly where the imaging process is to be capable of continuous operation.

The inventors have discovered that oil carrier ink images can be rapidly fixed without image distortion, oil bleed, or transparentizing of the transfer paper, if the images are applied to a transfer paper comprising a paper substrate which contains, internally, or externally as a coating, an oil-absorbent masking agent, and has a physically discontinuous overcoating of a thermoplastic fusing material. After image application, the thermoplastic fusing material is heated beyond its melting point to fix the images. The masking agent ensures rapid absorption of the oil which entrains the marking particles, and is designed to mask the oil after absorption to prevent the spotting or transparentizing of the paper material. The fusing overcoat, by being physically discontinuous, does not substantially bar the entry of the oil into the paper, and is then available as the plastic protective overcoat for image fixation.

DESCRIPTION OF THE INVENTION

This invention is useful in the fixing of any images where the image material is comprised of marking particles, such as, for example, photosensitive pigments disclosed in the above-referred-to photoelectrophoresis patents, suspended in an oil carrier. By an oil carrier is meant an oil which is liquid at room temperatures and which is not a solvent for the marking particles. The principles of this invention can be extended to fixing an ink image having generically as a carrier any nonvolatile liquid material. A representative listing of oils is found in the Condensed Chemical Dictionary. The image may be formed in any suitable manner, examples of which are contained in the referenced patents. The image may be applied or transferred to the transfer sheet of this invention in any suitable manner. For examples of transfer, reference to the above patents is again given.

As before mentioned, the transfer sheet of this invention comprises a paper substrate containing an oil absorbent masking agent. The masking agent serves two purposes: first, by being oil-absorbent, it hastens the pickup of the oil by the substrate and removes the bulk of the oil from the sheet surface where it would interfere with image fixing; second, the masking agent should be so selected as to mask-over any tendency of the oil to "spot" or transparentize the paper substrate. Thus, pigments such as titanium dioxide, which are also oil absorbent, are ideally suited as masking agents. Any suitable material with those characteristics may be used herein. Representative other compounds are clay, diatomaceous earth, starch, hydrated calcium silicate, calcium carbonate, colloidal silica, casein, zinc sulfide, and so forth. The masking agent may be incorporated in the paper substrate fibers when the paper is produced, or it may be employed as a coating directly over the paper substrate, as in, for example, Kromekote paper. The exact amount to be used is not a critical feature of this invention; however, it must be sufficient to prevent spotting of the transfer sheet by the oil carrier, and to remove at least enough of the oil from the surface to prevent interference within the fusing material during the fixing step.

The paper substrate, thus treated with the masking agent, is then coated with the fusing thermoplastic. The coating is preferably a substantially uniform, physically-discontinuous coating. This simply means that there are gaps at substantially regular intervals in the thermoplastic coating. The gaps provide a quicker means of entry for the oil through the thermoplastic coating into the substrate. The gaps should be uniformly disposed for uniform oil penetration. The exact configuration of the discontinuities is not of the essence of this invention. The fusing material coating may contain, for example, small uniformly-spaced uncoated dot areas; or, the thermoplastic film may itself comprise a coated dot pattern with the discontinuity being the uncoated areas surrounding each dot of thermoplastic. It has been found that the latter type of coating can be easily applied by rolling a gravure cylinder loaded with the thermoplastic solution across the paper substrate. This results in a coating having a grid-like discontinuity pattern corresponding to the raised grid structure of the gravure pattern.

The discontinuous area of the thermoplastic overcoating should be large enough to permit rapid oil penetration, but not so large that there is insufficient thermoplastic material to provide a good image fix. However, it has been found that, where the thermoplastic is particularly compatible at elevated temperatures with the oil carrier in the ink, an overcoating with a relatively large area of discontinuity may be used if the transfer sheet contains an ultra-thin substantially continuous coating just beneath the discontinuous overcoating.

Compatibility can be determined by heating a mixture of a thermoplastic and the oil, at, for example, a 3 to 1 ratio, to a liquid condition, and then allowing the mixture to cool. A compatible blend will form a hard cake with no tack or oil bleed. The thermoplastic should have a melting point well below the fusing temperature to be employed in the fixing process, and a viscosity at the fusing temperature which is low enough to permit the thermoplastic to quickly flow into the previously discontinuous, uncoated areas, but not so low that the flow will entrain pigment and blur the image. Where the oil carrier is mineral oil, a particularly preferred thermoplastic is a polystyrene having an average molecular weight of about 800 to about 12,000, a melting point of from about 50° C, to about 150° C, and a melt viscosity between 150° C and 200° C of at least about 4 poises, and preferably greater than 15 poises. Polystyrenes having these characteristics are available in pure, solid form from the Hercules Chemical Co., under the tradename of Piccolastic, particularly the D and E series.

EXAMPLE I

A masking agent coating system was formulated having the following composition:

53.6% titanium dioxide
23.0% water
5.7% Dow 636 (48% solids) latex
17.3% casein solution
0.4% Calgon (dispersant)

The casein solution is a binder and had the following composition: 16.1% Casein PMX; 83.1% water; and 0.8% of 28% ammonium hydroxide solution. The $TiO_2$ composition was then coated on Xerox 1024 paper using a No. 4 wire-wound rod to yield a dried coat weight of about ten pounds per 3,000 square feet.

EXAMPLES II-XIII

Transfer papers prepared in accordance with Example I were then overcoated variously with Piccolastic D-100, melting point of about 100° C, melt viscosity of about 5 to 45 poises between 150° C, and 200° C, and Piccolastic E-125, melt viscosity of about 100 to 750 poises between 150° C and 200° C, both polystyrenes being applied in toluene solution. The resin solutions were applied to the papers from Q-type gravure cylinders using a Dixon Coater. The gravure cylinder is designated by a number which specifies the quantity of cells per diagonal inch. The overcoated pattern resembles a plurality of squares of thermoplastic, each square having a thin-line uncoated border surrounding it resulting from the raised grid pattern of the cylinder. Transfer sheets thus prepared were brought into contact with positive images formed on NESA glass with a photoelectrophoretic ink comprised of color pigments suspended in mineral oil, at a pigment to oil ratio of 40%. The images were formed using an apparatus similar to that shown, for example, in FIG. 1A in U.S. Pat. No. 3,384,566, referred to above. The imaged transfer sheets were then fixed by being drawn across a bar heated to the below-listed temperature at various fuser bar contact times. The images, all of good quality, were then tested for degree of fix by drawing a two-inch square cotton swatch with a 500 gram weight thereon across a six-inch strip of the print; degree of rub-off is observed and compared to control swatches of complete fix to no-fix; a scale of one to five is used, the higher the number the better the fix. The results are as follows:

| Ex. | Overcoat | Gravure Cell | Fuser Temperature | Fuser Contact Time | Degree Of Fix |
|---|---|---|---|---|---|
| II | 40% Piccolastic E-125 | 75Q | 350° F | 1.4 sec. | 5 |
| III | 40% Piccolastic E-125 | 75Q | 350° F | 0.6 sec. | 4 |
| IV | 40% Piccolastic E-125 | 75Q | 350° F | 0.3 sec. | 4 |
| V | 51% Piccolastic E-125 | 75Q | 350° F | 1.4 sec. | 4 |
| VI | 51% Piccolastic E-125 | 75Q | 350° F | 0.6 sec. | 4 |
| VII | 51% Piccolastic E-125 | 75Q | 350° F | 0.3 sec. | 4 |
| VIII | 65% Piccolastic D-100 | 75Q | 350° F | 1.4 sec. | 4 |
| IX | 65% Piccolastic D-100 | 75Q | 350° F | 0.6 sec. | 4 |
| X | 65% Piccolastic D-100 | 75Q | 350° F | 0.3 sec. | 4 |
| XI | 50% Piccolastic E-125 | 95Q | 400° F | 1.4 sec. | 4–5 |
| XII | 50% Piccolastic E-125 | 95Q | 400° F | 0.6 sec. | 4–5 |
| XIII | 50% Piccolastic E-125 | 95Q | 400° F | 0.3 sec. | 4 |

EXAMPLE XIV–XVI

An imaged transfer paper was prepared using the above procedures having a 200 Q gravure overcoat of 50% Piccolastic E-125. Fixing was relatively inadequate probably due to the lower quantity of resin laid down by the cylinder. Another transfer sheet was prepared with an intermediate thin substantially continuous coating of 40% Piccolastic E-125 having a dried weight of about 2.7 lbs. per 3,000 square feet, overcoated with a 200 Q gravure coating of 50% Piccolastic E-125. Results:

| Example | Fuser Temperature | Fuser Contact Time | Degree Of Fix |
|---|---|---|---|
| XIV | 400° F | 1.4 sec. | 5 |
| XV | 400° F | 0.6 sec. | 4 |
| XVI | 400° F | 0.3 sec. | 4 |

What is claimed is:

1. A method for fixing an image, comprised of marking particles suspended in an oil carrier, which comprises:
   a. applying said image to a transfer paper comprised of a paper substrate which contains an oil-absorbent masking material, and which bears a physically-discontinuous overcoating of a thermoplastic fusing material;
   b. heating said fusing material beyond its melting point such that the fusing material flows and forms an essentially continuous overcoat on the paper; and
   c. allowing said fusing material to cool to fix the image.

2. The method of claim 1 wherein said discontinuous overcoat of fusing material is a substantially uniform pattern of discrete dots of said fusing material.

3. The method of claim 2 where the transfer paper bears an additional thin substantially continuous coating of a thermoplastic fusing material beneath said discontinuous overcoating of fusing material.

4. The method of claim 2 where said image is comprised of photosensitive pigment particles suspended in a mineral oil carrier.

5. The method of claim 4 where the thermoplastic fusing material in said discontinuous overcoating consists essentially of polystyrene resin.

6. The method of claim 5 wherein said dot pattern is a gravure pattern.

7. The method of claim 5 wherein said oilabsorbent masking material is a member selected from the group consisting of: titanium dioxide, diatomaceous earth, clay, hydrated calcium silicate, calcium carbonate, colloidal silica, casein, and zinc sulfide.

8. The method of claim 7 wherein the masking material is contained in the paper substrate composition.

9. The method of claim 7 wherein the masking material is overcoated on the paper substrate.

* * * * *